US005697986A

United States Patent [19]

Haas

[11] Patent Number: 5,697,986

[45] Date of Patent: Dec. 16, 1997

[54] FUELS AS SOLVENTS FOR THE CONDUCT OF ENZYMATIC REACTIONS

[75] Inventor: Michael J. Haas, Oreland, Pa.

[73] Assignee: The United States of America, as represented by the Secretary of Agriculture, Washington, D.C.

[21] Appl. No.: 631,497

[22] Filed: Apr. 12, 1996

[51] Int. Cl.[6] ..... C10L 1/18; C10L 1/26

[52] U.S. Cl. ..... 44/308; 44/307; 44/376; 44/377; 44/386; 44/388

[58] Field of Search ..... 44/307, 308, 376, 44/377, 386, 388

[56] References Cited

U.S. PATENT DOCUMENTS

| | | | |
|---|---|---|---|
| 4,695,411 | 9/1987 | Stern et al. | 44/388 |
| 5,525,126 | 6/1996 | Basu et al. | 44/308 |
| 5,578,090 | 11/1996 | Bradin | 44/308 |

OTHER PUBLICATIONS

Macrae, A., "Lipase–Catalyzed Interesterification of Oils and Fats", *JAOCS*, vol. 60(2), pp. 291–294, 1983.

Antonini et al., "Enzyme Catalysed Reactions in Water–Organic Solvent Two–Phase Systems", *Enzyme Microb. Tech.*, vol. 3, pp. 291–296, 1981.

Marmer et al., "Rapid Enzyme–Induced Hydrolysis of Microgram Amounts . . . ", *LIPIDS*, vol. 13(12), pp. 840–843, 1978.

Zaks et al., "Enzymatic Catalysis in Organic Media at 100° C.", *Science*, vol. 224, pp. 1249–1251, 1984.

Parida et al., "Substrate Structure and Solvent Hydrophobicity Control . . . ", *J. Am. Chem. Soc.*, vol. 113(6), pp. 2253–2259, 1991.

Laane et al., "Rules for Optimization of Biocatalysis in Organic Solvents", *Biotechnology and Bioengeering*, vol. 30, pp. 81–87, 1987.

*Primary Examiner*—Jerry D. Johnson
*Attorney, Agent, or Firm*—M. Howard Silverstein; John Fado; Janelle S. Graeter

[57] ABSTRACT

The present invention describes a method of producing biofuels by carrying out the enzymatic transesterification of fatty acid-containing materials directly in automotive fuels.

8 Claims, 14 Drawing Sheets

FUELS AS SOLVENTS FOR THE CONDUCT OF ENZYMATIC REACTIONS

BACKGROUND OF THE INVENTION

1. Field of the Invention

Fatty acid esters are being utilized both as automotive fuels and in blends with petroleum-derived fuels. The present invention relates to a method of producing esters directly in automotive fuels, thereby eliminating isolation and purification prior to blending.

2. Description of the Prior Art

The use of lipophilic organic liquids as solvents for the conduct of enzyme-catalyzed reactions has gained considerable attention since its description over 20 years ago (Antonini et al. 1981. *Enzyme Microb. Tech.* vol. 3, pp. 291–296; A. R. Macrae. 1983. *J. Am. Oil Chem. Soc.* vol. 60, pp. 291–294; Zaks and Klibanov. 1984. *Science.* vol. 224, pp. 1249–1251). For many types of reactions this approach offers advantages over water-based reactions. Among these are enhanced catalyst stability, increased substrate/product solubility, decreased side reactions, an absence of microbial contamination, and the ability to conduct reactions which are thermodynamically unfavorable in aqueous systems. Accordingly, there has been considerable research in this area, often employing enzymes known as lipases (triacylglycerol acylhydrolase, E.C. 3.1.1.3) as catalysts (Blanch and Clark, eds. 1991. *Applied Biocatalysis,* Vol. 1. Marcel Dekker, Inc. New York, N.Y.; J. S. Dordick, ed. *Biocatalysts for Industry,* Plenum Press, New York, N.Y.). In general, the solvents utilized have been hexane or isooctane, due largely to the fact that solvents in this polarity range often support the highest enzyme activities, although enzymes are known to display activity in various solvents having a range of polarities (Laane et al. 1987. *Biotechnology and Bioengineering.* vol. 30, pp. 81–87; Goldberg et al. 1990. *Eur. J. Biochem.* vol. 190, pp. 603–609; Parida and Dordick. 1991. *J. Am. Chem. Soc.* vol. 113, pp. 2252–2259; Valvety et al. 1992. *Biochim. Biophys. Acta.* vol. 1118, pp. 218–222; Haas et al. 1993. *J. Am. Oil Chem. Soc.* vol. 70, pp. 111–117). It has been shown that lipases are able to catalyze the alcoholysis of triglycerides in aqueous (Briand et al. 1994. *Biotechnol. Lett.* vol. 16, pp. 813–818; Boutur et al. 1994. *Biotechnol. Lett.* vol. 16, pp. 1179–1182) as well as non-aqueous systems (Zaks and Kilbanov, supra; M. Mittelbach. 1990. *J. Am. Oil Chem. Soc.* vol. 67, pp. 168–170; Trani et al. 1991. *J. Am. Oil Chem. Soc.* vol. 68, pp. 20–22; Ergan et al. 1991. *J. Am. Oil Chem. Soc.* vol. 68, pp. 412–417; Shaw et al. 1991. *Enzyme Microb. Technol.* vol. 13, pp. 544–546; Linko et al. 1994. *J. Am. Oil Chem. Soc.* vol. 71, pp. 1411–1414).

Although triglycerides can fuel diesel engines, their relatively high viscosities and other problems have led to the investigation of various derivatives. Chief among these are fatty acid esters, which are currently the favored compounds for biodiesel. Methyl esters derived from various vegetable oils by chemical transesterification with methanol (alcoholysis) have received the most attention. Due to the relatively high costs of vegetable oil, however, methyl esters produced from it cannot compete economically with petroleum diesel. There has thus been a need to explore alternate feedstocks for the production of biodiesel.

SUMMARY OF THE INVENTION

I have discovered that lipases are catalytically active in automotive fuels and are effective for the alcoholysis of fatty acid-containing substances for the formation of fatty acid esters for the production of biofuels.

In accordance with this discovery, it is an object of the invention to provide a method for the production of biofuels by combining fatty acid-containing substances, alcohol and enzyme in automotive fuel.

Other objects and advantages of the invention will become readily apparent from the following description.

DETAILED DESCRIPTION OF THE INVENTION

Figure 1A:
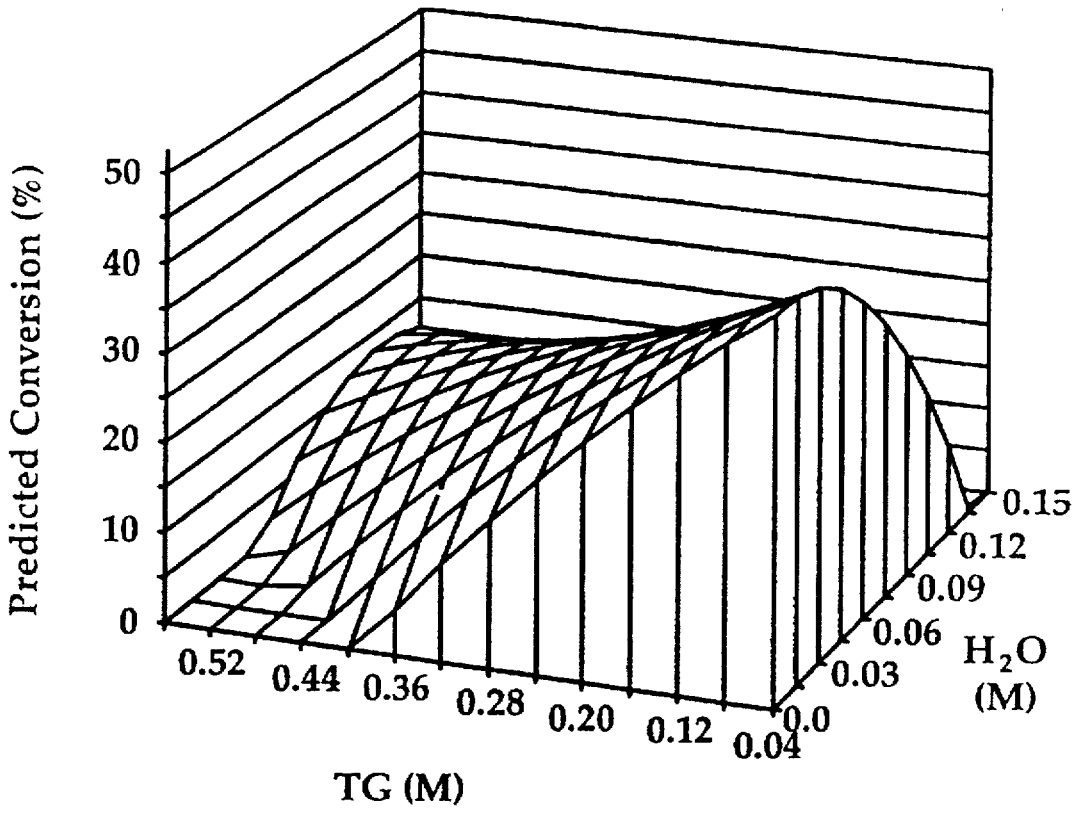
FIG. 1 shows the predicted degrees of ethanolysis of soybean triglycerides (TG) in diesel fuel, as a fraction of maximum theoretical conversion and as a function of the amounts of added TG and water, by three commercial lipase preparations at 42° C. Results are derived from Equation 1 and Table 2. (A) Lipozyme™ IM20 lipase (35 mg), ethanol (330 mM), 28-hr incubation; (B) as (A) but ethanol at 925 mM; (C) CE lipase (50 mg), ethanol (330 mM), 20-hr incubation; (D) as (C) but ethanol at 925 mM; (E) PS-30 lipase (35 mg), ethanol (330 mM), 6-hr incubation; (F) as (E) but ethanol at 925 mM.
Figure 1B:
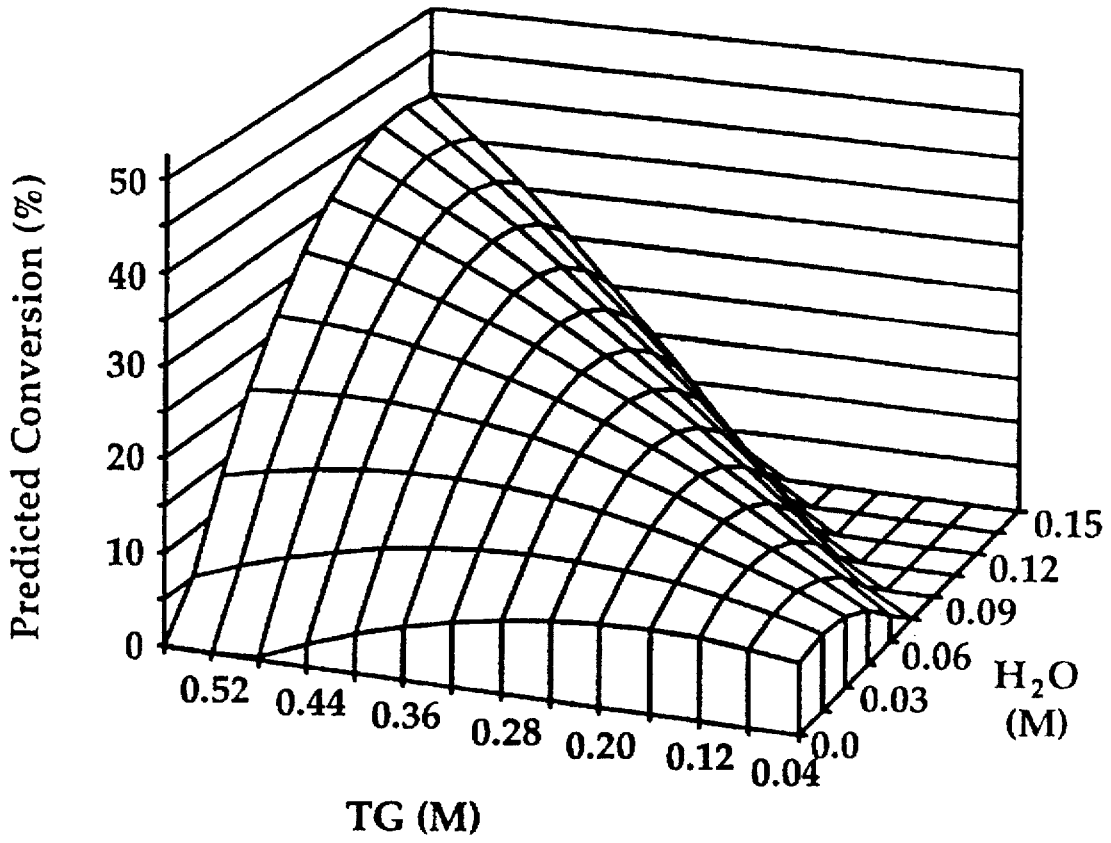

"Biodiesel" is the term applied to ester-based fuel oxygenates derived from biological sources and intended for use in compression-ignition engines (from *Biodiesel: A Technology, Performance, and Regulatory Overview.* 1994. National Soy Diesel Development Board, Jefferson City, Mo.). There are a number of advantages to the use of biodiesel as a fuel: (a) it is domestically-produced, offering the possibility of reducing petroleum imports; (b) it is plant, not petroleum, derived, and, as such, its combustion does not increase net atmospheric levels of $CO_2$, a "greenhouse" gas, (c) it is biodegradeable; and (d) relative to conventional diesel fuel, its combustion products have reduced levels of particulates, carbon monoxide and, under some conditions, nitrogen oxides. There is thus considerable interest in exploring and developing the use of biodiesel as a fuel.

Studies of the use of diesel fuel, a heterogenous mixture of liquid olefins, aromatics, and normal, cyclo- and branched paraffins, or any other common fuel, as a solvent for enzymatic catalysis have not heretofore been reported. Such liquids would be advantageous for the synthesis of biodiesel from glycerides since the ester products would be soluble in the solvent while other products (e.g. glycerol or glycerophosphorylcholine) and the catalyst itself would be insoluble, thereby greatly simplifying product recovery. In addition, crude lipid-containing mixtures not currently amenable to transesterification may be utilized. The processing of oilseeds for the production of edible vegetable oil generates byproduct streams containing mixtures of triglycerides, phospholipids and free fatty acids. In many cases these streams are of considerably lower value than the finished oil, and the possibility of increasing the value and utilization of these byproducts by using them as sources of fatty acids for fatty acid ester synthesis is very attractive. The enzymatic alcoholysis of a triglyceride and a phospholipid in diesel fuel was therefore investigated. Ethanol was used as the co-reactant alcohol since it can also be derived from renewable resources and since fatty acid ethyl esters are acceptable biodiesel fuels.

The novel transesterification process is carried out forming a reaction mixture by combining the starting materials (i.e. fatty-acid containing substances and alcohol), enzyme, solvent and sufficient water to confer enzymatic activity, incubating the reaction mixture for a time and at a temperature sufficient for the reaction (i.e. transesterification between the fatty acid-containing substance and the alcohol) to occur and separating the undesireable end products (glycerol, water and enzyme) from the alkyl ester-containing biofuel portion of the reaction mixture. Water is optionally included in the reaction mixture as needed to confer enzymatic activity on the catalyst. This amount is eithersupplied by the manufacturer or easily determined experimentally by one of skill in the art. The reaction is generally carried out at about room temperature, however, slightly elevated temperatures (up to about 60° C.) produce acceptable levels of enzyme activity. The amount of incubation time considered effective varies considerably from one enzyme/substrate combination to another. This amount is easily determined experimentally, however, by carrying out time course experiments. Starting materials are fatty acid-containing substances and alcohol. Acceptable fatty acid-containing substances are triglycerides, phospholipids, other fatty acid esters and other esters which are substrates for the particular enzyme chosen as catalyst. Acceptable alcohols are generally, but not limited to, those of the normal-, iso- and cyclo-series of alkyl alcohols. Examples are ethanol, propanol, isopropanol, 1-butanol, 2-butanol and isobutanol. Since higher molecular weight alcohols are more soluble in automotive fuels, they are generally more useful. Alcohol limitations are dictated by the choice of enzyme to be used as catalyst, since some will accept only primary alcohols while others will accept primary as well as secondary ones. The solvent is automotive and related fuels and includes diesel fuel, gasoline and similar materials. Effective lipases are any produced by plants, bacteria, fungi or higher eukaryotes. In general, the use of non-specific enzymes results in the production of a higher yield than fatty acid-specific enzymes. In the event that the esters of particular fatty acids are desired or particular fatty acid-containing substances are used as substrate, lipases having particular fatty acid specificities may be preferred. Ester production occurs directly in the fuel, eliminating isolation and purification prior to blending. End by-products (glycerol, water and enzyme) may be separated from the biofuel by conventional methods such as settling and phase separation.

For purposes of discussion, three commercially available lipases were investigated, and their abilities to synthesize fatty acid ethyl esters via the alcoholysis of soy triglycerides (TG) and phosphatidylcholine (PC) in grade No. 2 diesel fuel were evaluated. The enzymes utilized were: a) Liposym™ IM 20, a *Rhizomucor miehei* lipase immobilized on a Duolite resin (Novo Nordisk BioChem, Franklinton, N.C.); b) lipase CE, derived from *Humicola lanuginosa;* and c) lipase PS-30, derived from *Pseudomonas* sp. (both obtained from Amano Enzyme U.S.A. Co., Ltd., Troy, Va).

Initial studies demonstrated that all three enzymes were capable of synthesizing fatty acid esters by alcoholysis of glycerides in commercial diesel fuel. An additive-free diesel fuel (Base 11 Diesel fuel, Mobil Corp., Edison, N.J.) gave generally comparable performance in a series of abbreviated studies. The studies described herein, however, utilized fuel-grade material because of its ready availability.

Hydrolytic activities of the enzymes in aqueous reactions were poor predictors of transesterification activity in organic solvent: the aqueous hydrolytic activities of CE and PS-30 toward TG were roughly comparable, and 25 to 50 times greater than that of IM20 (Table 1). However, in the alcoholysis of TG in diesel fuel the order of activities was PS-30>IM20>CE. The activities of IM20 and CE toward PC were similar to one another, while PS-30 was considerably less active on this substrate. CE lipase was more active toward PC than toward TG while IM20 displayed comparable activity toward both substrates. PS-30 was considerably more active on TG than on PC. Degrees of conversion achieved were consistent with the transesterification of only one fatty acid of TG, and slightly greater than one fatty acid for PC.

All three enzyme preparations were found to be active in water-saturated diesel fuel, synthesizing fatty acid esters from both TG and PC. Response surface methodology, based on a Modified Central Composite design, was employed to examine the coordinate effects of lipid, water and ethanol concentrations on enzyme activities and to identify conditions yielding maximum alcoholysis.

TABLE 1

Aqueous Hydrolytic Activities of Selected Lipases[a]

| Enzyme[b] | pH | Activity (U/mg)[c] |
|---|---|---|
| Lipozyme IM 20 | 8.0 | 0.37 |
| Amano PS-30 | 8.0 | 17.8 |
| Amano CE | 8.0 | 8.81 |

[a]Enzyme activities were determined using emulsified soybean oil as the substrate according to the procedure described in the text under Determination of Lipolytic Activiy. All activities were determined at pH 8, the optimal pH for each of these enzymes.
[b]Lipozyme IM 20 from Novo Nordisk Biochem (Franklinton, NC); PS-30 and CE from Amano Enz. Co. Ltd. (Troy, VA).
[c]U = μmole fatty acid released per minute, using emulsified soybean oil as substrate.

Statistical experimental design concepts were used to determine the coordinate dependence of the alcoholysis activities of these enzymes in diesel fuel on the concentrations of water, lipid, and ethanol. As a result, predictive equations were derived which relate enzyme activity to the composition of the reaction mixture. The estimated regression equations resulting from these studies are of the form shown in Equation [1]:

$$\text{Predicted esterification (\%)} = X_0 + X_1(\text{Lipid} + X_2(\text{Water}) + X_3(\text{Ethanol}) + X_4(\text{Lipid})(\text{Water}) + X_5(\text{Lipid})(\text{Ethanol}) + X_6(\text{Water})(\text{Ethanol}) + X_7(\text{Lipid})^2 + X_8(\text{Water})^2 + X_9(\text{Ethanol})^2$$

where the coefficients $X_0$, $X_1$, $X_2$, etc. are unique for each enzyme-substrate pair and are listed in Table 2 (concentrations expressed in units of molarity). These values are calculated according to conventional statistical methods from experimental data. The $R^2$ values for these calculations indicate that the derived models fit the data well, accounting for approximately 64 to 72% of the total variability of the data in the case of TG and for greater than 80% of the variability of the data in the case of PC as the substrate (Table 2). The coefficients also indicate

TABLE 2

Coefficients of the Generic Equation (Equation 1)[a] Relating Esterification Activity to Reactant Concentrations

| Enzyme | Substrate | $X_0$ | $X_1$ | $X_2$ | $X_3$ | $X_4$ | $X_5$ | $X_6$ | $X_7$ | $X_8$ | $X_9$ | $R^{2(b)}$ |
|---|---|---|---|---|---|---|---|---|---|---|---|---|
| Lipozyme IM20 | Triglyceride | 37.57 | −0.1447 | −34.50 | 0.0581 | −0.0001 | 1.160 | −2533 | 0.0002 | 0.0647 | −0.0001 | 0.6375 |
| CE | Triglyceride | 48.18 | −0.0846 | −76.00 | −0.0035 | −0.0001 | 0.5647 | −554.3 | 0.0001 | −0.0190 | 0 | 0.7075 |
| PS-30 | Triglyceride | 5.844 | 0.0254 | 124.8 | 0.0492 | −0.0002 | 0.3300 | −703.3 | 0 | −0.0803 | 0 | 0.7235 |
| Lipozyme IM20 | Phosphatidylcholine | 32.29 | 0.0090 | 3.589 | −0.0100 | 0.0004 | 0.1045 | −9.962 | 0.0001 | −0.0059 | 0 | 0.9332 |
| CE | Phosphatidylcholine | 13.30 | 0.1095 | 16.58 | −0.0030 | 0.0007 | 0.0703 | −5.552 | 0.0001 | −0.0055 | 0 | 0.9008 |
| PS-30 | Phosphatidylcholine | 52.566 | −137.2 | −4.876 | −33.78 | 1.345 | 52.50 | 2.651 | 202.8 | 0.2539 | 0.3822 | 0.8180 |

[a]Predicted esterification (%) = $X_0 + X_1$ (Lipid) + $X_2$ (Water) + $X_3$ (Ethanol) + $X_4$ (Lipid)(Water) + $X_5$ (Lipid)(Ethanol) + $X_6$ (Water)(Ethanol) + $X_7$ (Lipid)$^2$ + $X_8$ (Water)$^2$ + $X_9$ (Ethanol)$^2$. Concentrations expressed in moles/liter.
[b]$R^2$: Coefficient of determination.

that the enzyme activities were generally most sensitive to variations in the water concentration and the interaction of water and ethanol concentrations (Table 2).

Using the data in Equation 1 and Table 2, response surfaces were constructed which display the predicted degrees of alcoholysis of TG and PC over the range of water and lipid concentrations studied here (FIGS. 1 and 2). For each enzyme, response surfaces are displayed for two ethanol concentrations: those flanking the midpoint value in Table 3 (see Example 2). These surfaces allow the identification of the reaction conditions which are predicted to yield optimum enzyme activity.

Just as in the hydrolysis of soybean oil in aqueous reactions (Table 1), of the enzymes studied here, PS-30 displayed the most activity in the transesterification of TG in diesel fuel. A six-hour incubation with this enzyme resulted in degrees of transesterification not achieved with IM20 or CE until more than 20 hours of incubation (FIG. 1). It is also notable that despite the substantially lower activity of IM20 in the aqueous hydrolytic reaction (Table 1), the amount of this enzyme and the duration of incubation required to obtain significant esterification of TG in diesel fuel was not vastly different than for CE and PS-30 (FIG. 1).

It is known that enzymes may require some water in order to be active in organic solvents, but that an excess of water causes inactivation. In the alcoholysis of TG, the enzymes studied

TABLE 3

Settings for the Variable Factors Examined[a]

| Substrate | Factor | Enzyme | Minimum | Midpoint | | Maximum | |
|---|---|---|---|---|---|---|---|
| Soy Tri-glyceride | Substrate | All | 0.19 | 0.70 | 1.17 | 1.57 | 1.80 |
| | Water | IM20 (35 mg) | 0 μL | 2.5 | 5 | 10 | 15 |
| | | CE (50 mg) | 2.5 μL | 6 | 13 | 20 | 25 |
| | | PS-30 (35 mg) | 0 μL | 6 | 15 | 24 | 30 |
| | Ethanol | All | 45 μL | 100 | 195 | 290 | 350 |
| | Substrate | All | 0.20 g | 0.58 | 1.05 | 1.41 | 1.67 |
| | Water | IM20 (35 mg) | 5 μL | 15 | 90 | 135 | 200 |
| | | CE (50 mg) | 5 μL | 30 | 140 | 250 | 350 |
| | | PS-30 (35 mg) | 450 μL | 600 | 750 | 900 | 1050 |

TABLE 3-continued

Settings for the Variable Factors Examined[a]

| Substrate | Factor | Enzyme | Minimum | Midpoint | | Maximum | |
|---|---|---|---|---|---|---|---|
| | Ethanol | IM20 | 100 μL | 240 | 450 | 660 | 800 |
| | | CE | | | | | |
| | | PS-30 | 50 μL | 100 | 150 | 200 | 250 |

[a]Reaction mixtures were formulated by dissolving sufficient lipid in diesel fuel to attain the indicated amounts of substrate in 5 mL of solution, then dispensing 5 mL to reaction tubes and adding the specified amounts of water, ethanol and enzyme.

displayed a marked sensitivity to water that was largely independent of the concentrations of lipid and ethanol (FIG. 1). PS-30 was the most resistant to this effect, but even its activity maximum occurred at or below an added water concentration of 150 mM over and above that necessary to saturate the solvent (13.5 μl per ml reaction mixture). For all three enzymes, optimal activities toward TG occurred at added water concentrations of less than 0.3M. With PC as substrate, optimal enzyme activities occurred at added water concentrations as much as ten-fold greater than this, and the amount of water required for maximum activity was proportional to the substrate concentration.

In general, the alcoholysis of TG and PC was slightly affected by variations in the ethanol concentration, with a slight to moderate reduction in transesterification as the ethanol concentration increased (FIGS. 1 and 2). IM20, however, displayed a marked response to the ethanol concentration in the alcoholysis of TG where the degree of conversion of TG could be significantly increased by providing increased amounts of alcohol. At low alcohol concentrations (e.g. 0.33M), the degree of predicted transesterification was approximately 30% at the lowest levels of substrate, and declined at higher levels (FIG. 1A). At higher ethanol concentrations (e.g. 0.9M), the activity increased as the substrate concentration increased, reaching a maximum of 40% (FIG. 1B). For both TG and PC, however, the enzyme activities were generally reduced as ethanol concentrations rose, with the exception of the IM20/TG combination, where activity increased with increasing ethanol concentrations, and a PS-30/PC combination, where activity was roughly constant across the range of water and ethanol concentration examined.

Approximately constant percentages of TG esterification were predicted for the enzymes CE and PS-30 across a ten-fold range of substrate concentrations (FIG. 1 C–F). This suggests that these enzymes were not substrate-saturated at these lipid concentrations. Since the response surface methods and incubation times used here were designed to identify optimal reaction conditions with respect to enzyme activity, not maximum yields, the fact that the extents of predicted esterification reached only 10 to 30% in these studies does not address the issue of the maximum yields that might be achievable. Maximizing yields would be achieved by, for example, increasing amount of enzyme and/or increasing incubation time.

Figure 1C:
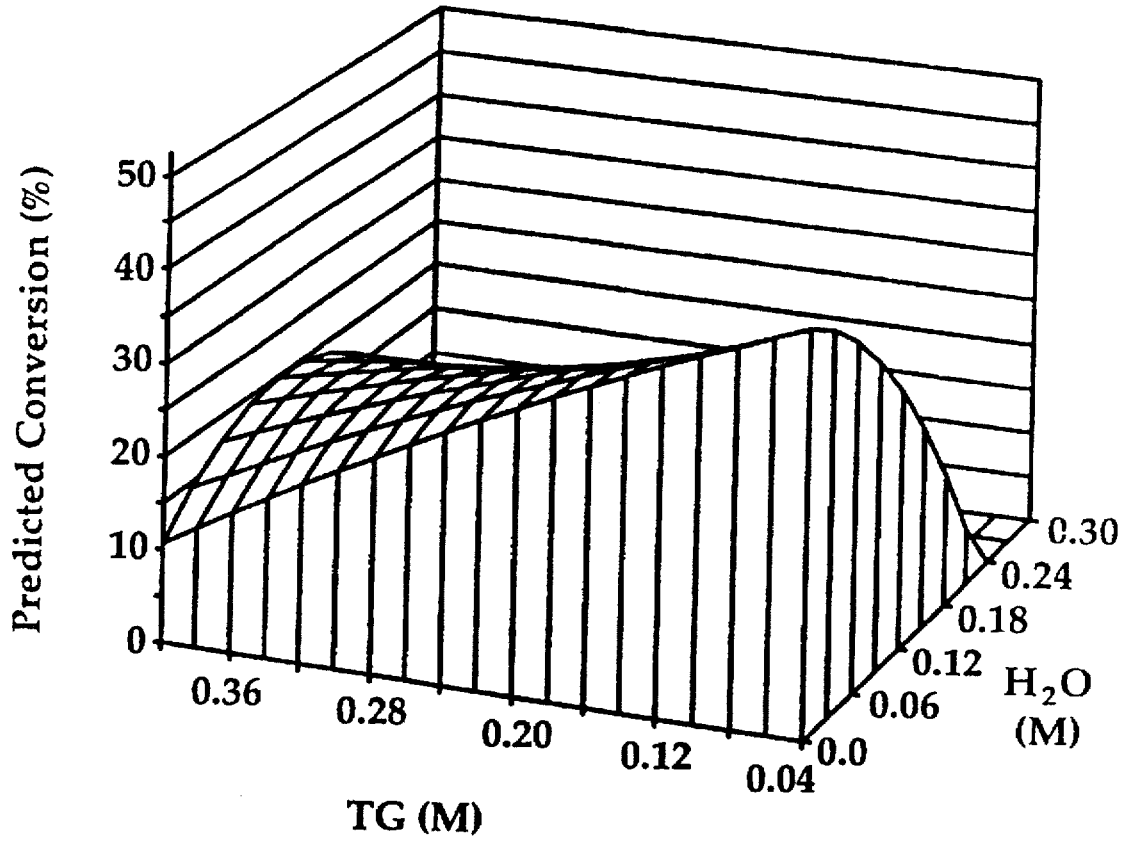
Figure 1D:
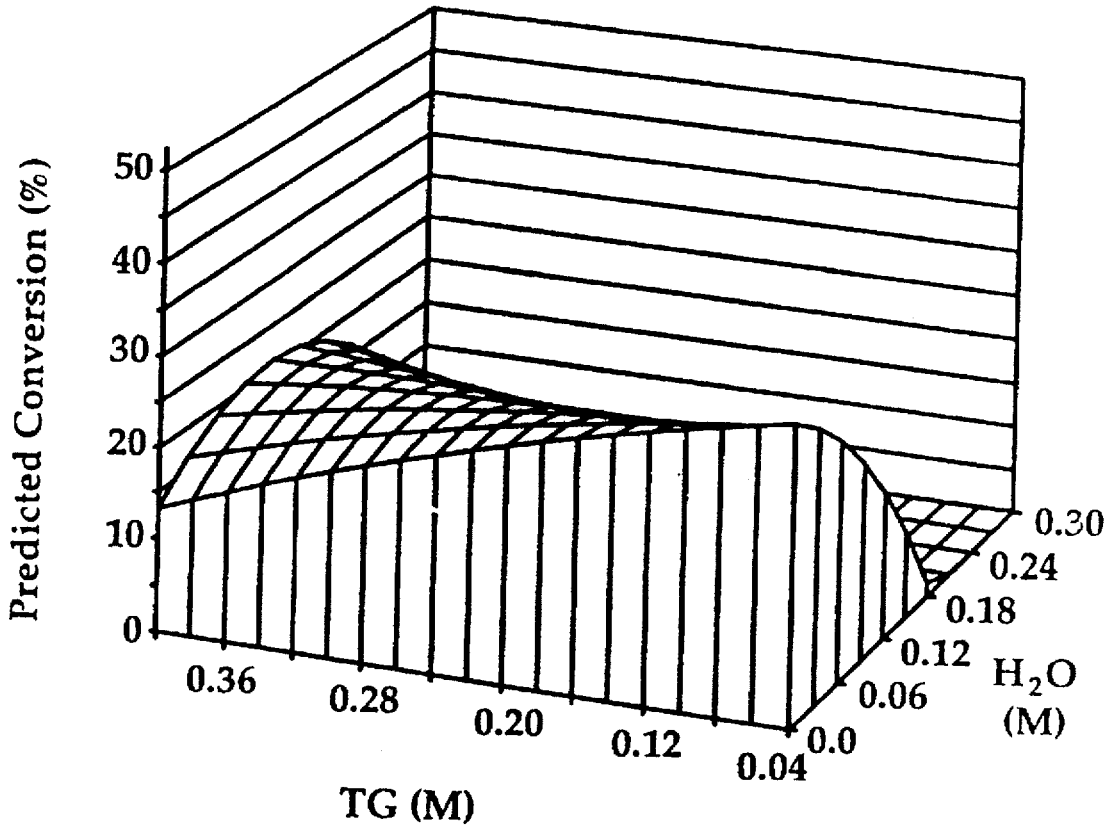
Figure 1E:
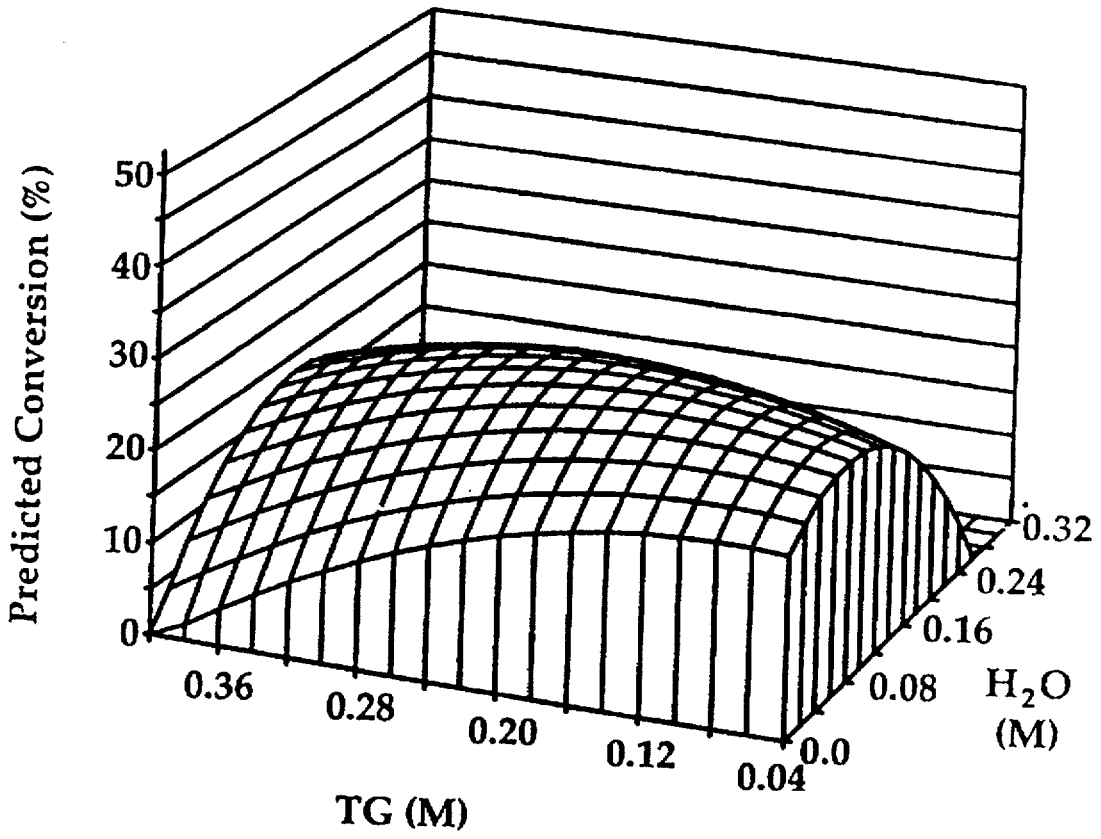
Figure 1F:
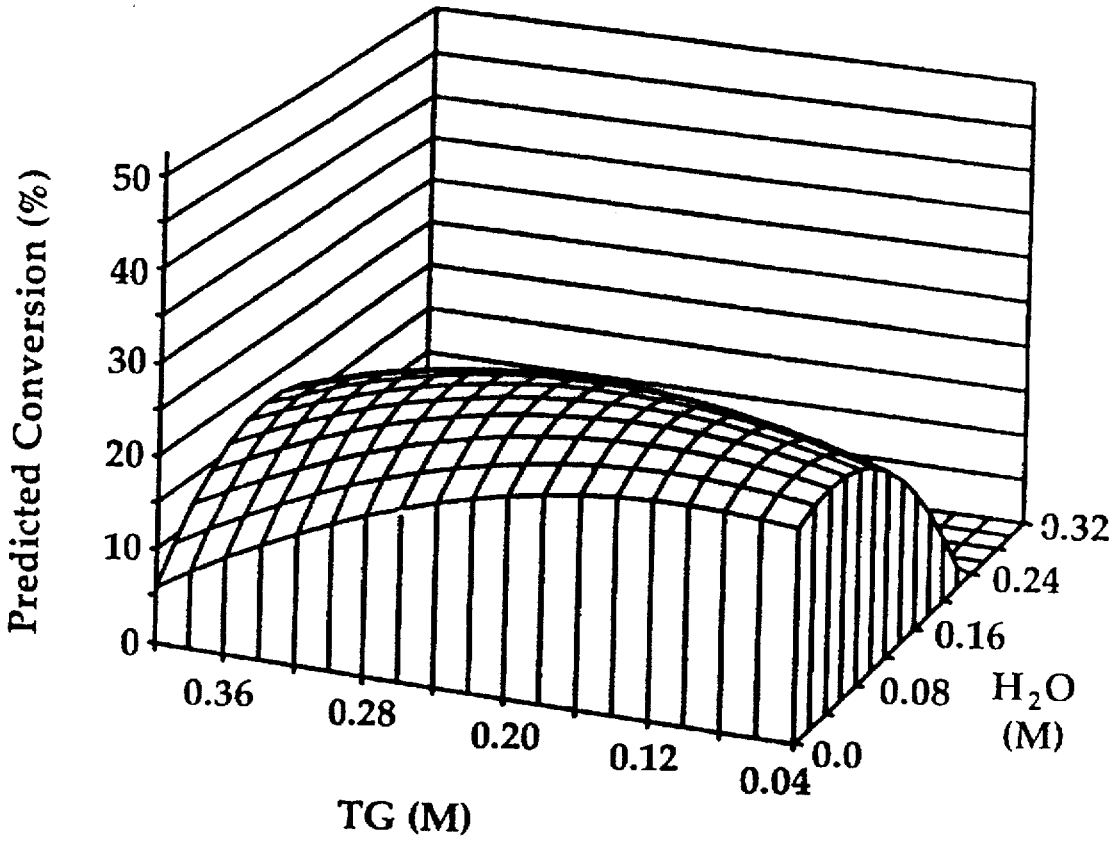
Figure 2A:
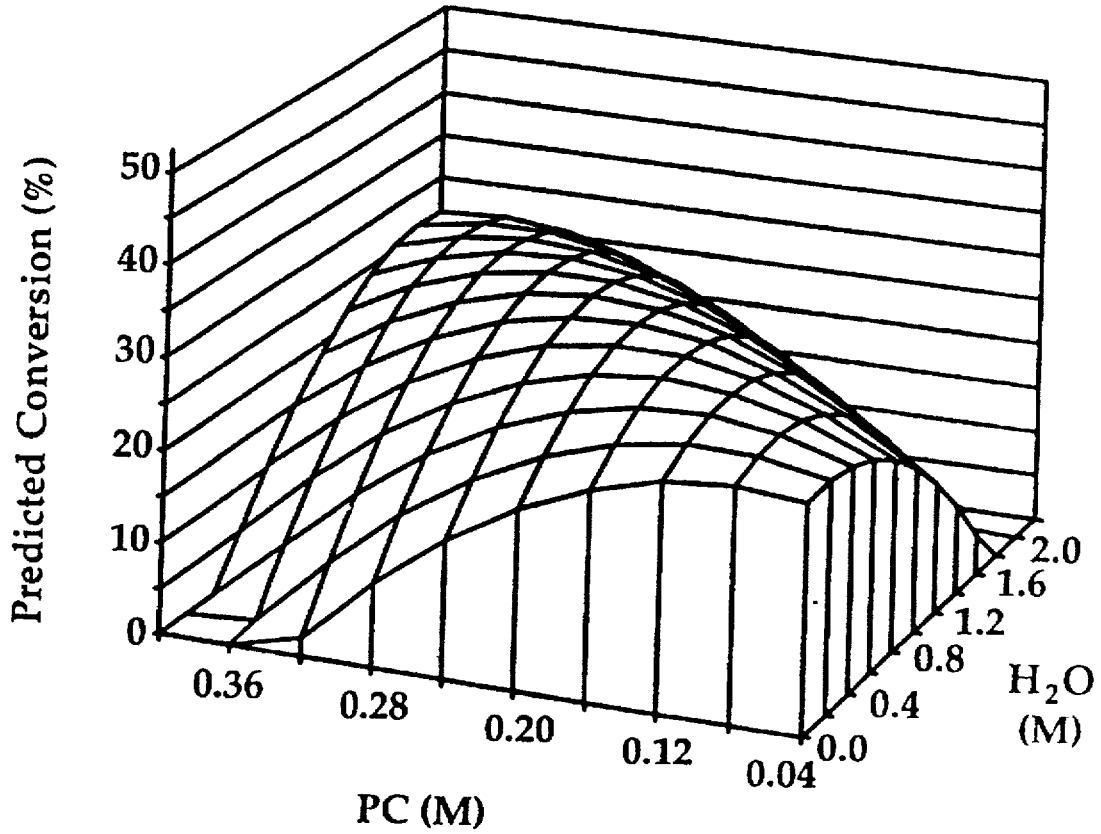
FIG. 2 shows the predicted degrees of ethanolysis of soybean phosphatidylcholine (PC) in diesel fuel, as a fraction of maximum theoretical conversion and as a function of the amounts of added PC and water, by commercial lipase preparations at 42° C. Results are derived from Equation 1 and Table 2. (A) Lipozyme™ IM20 lipase (35 mg), ethanol (750 mM), 48-hr incubation; (B) as (A) but ethanol at 1950 mM; (C) CE lipase (50 mg), ethanol (750 mM), 17-hr incubation; (D) as (C) but ethanol at 1925 mM; (E) PS-30 lipase (35 mg), ethanol (301 mM), 49.5-hr incubation; (F) as (E) but ethanol at 591 mM.
Figure 2B:
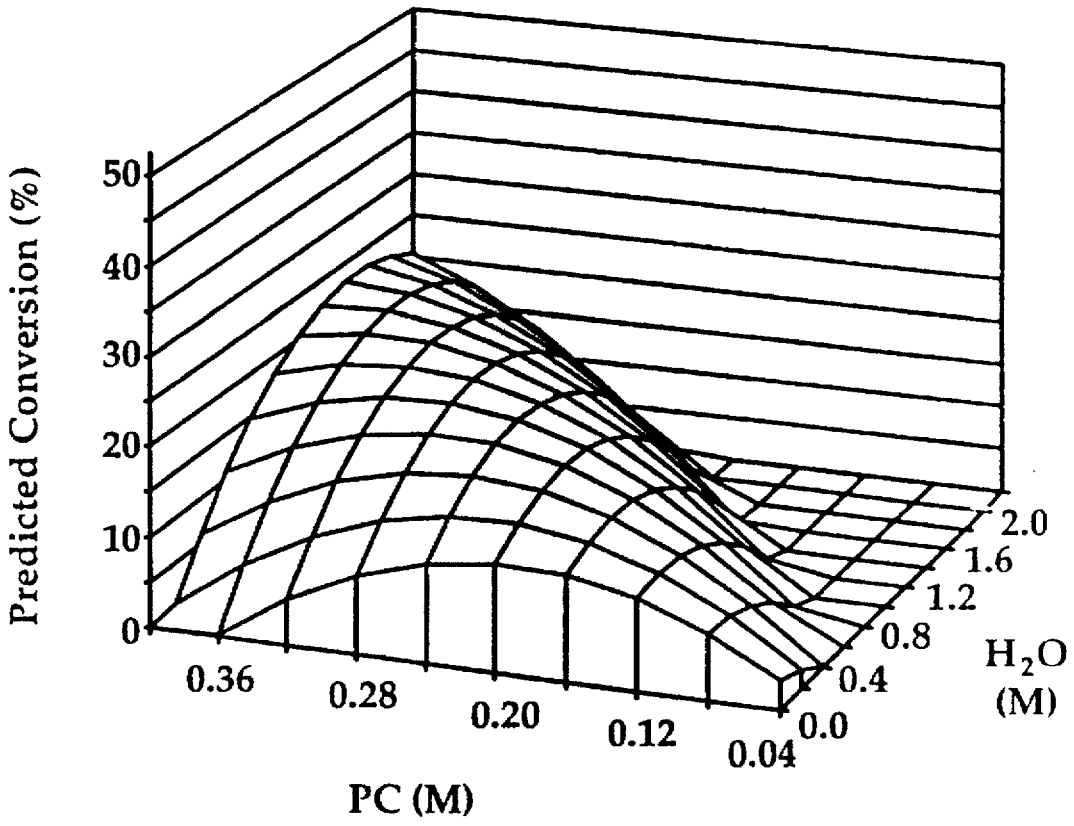
Figure 2C:
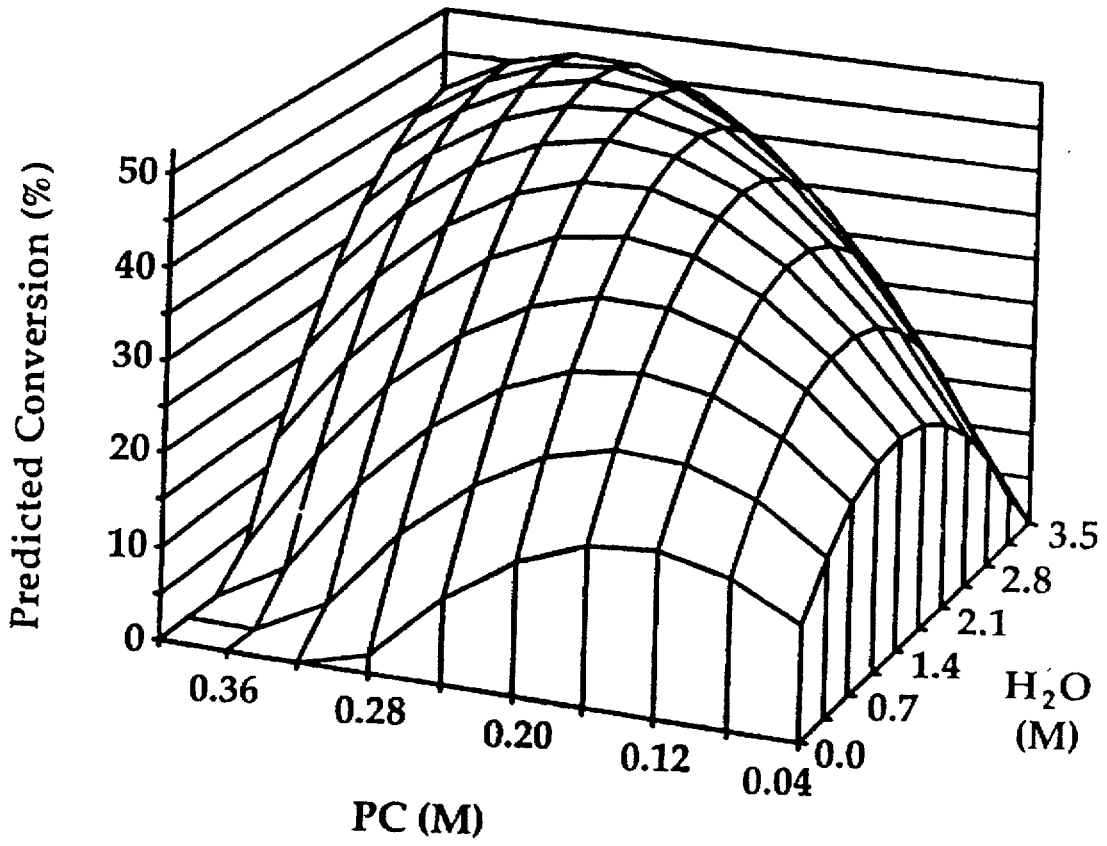
Figure 2D:
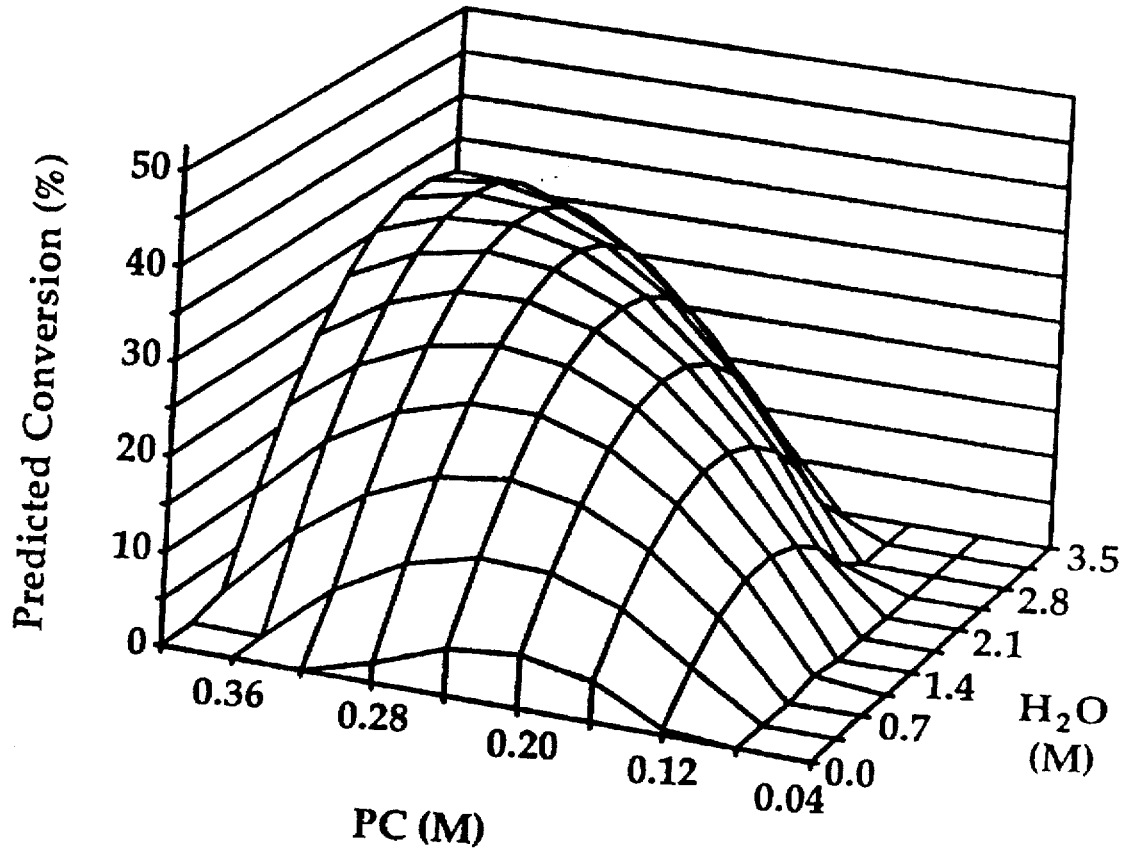
Figure 2E:
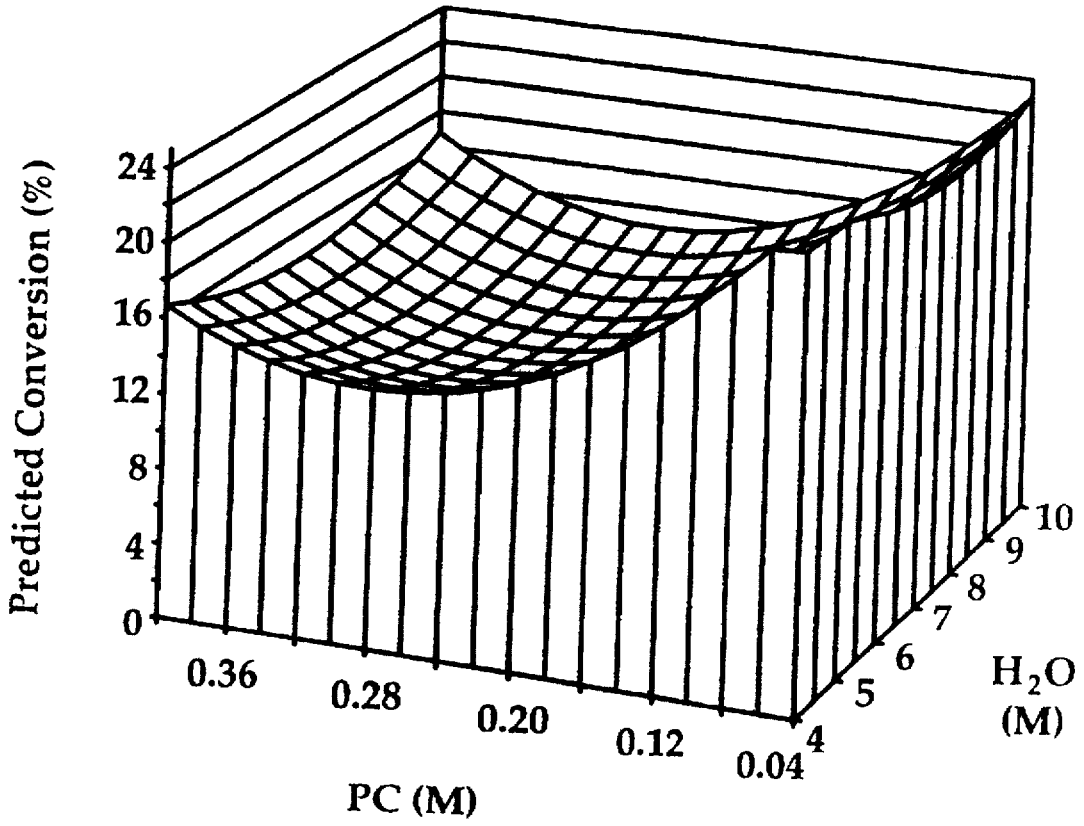
Figure 2F:
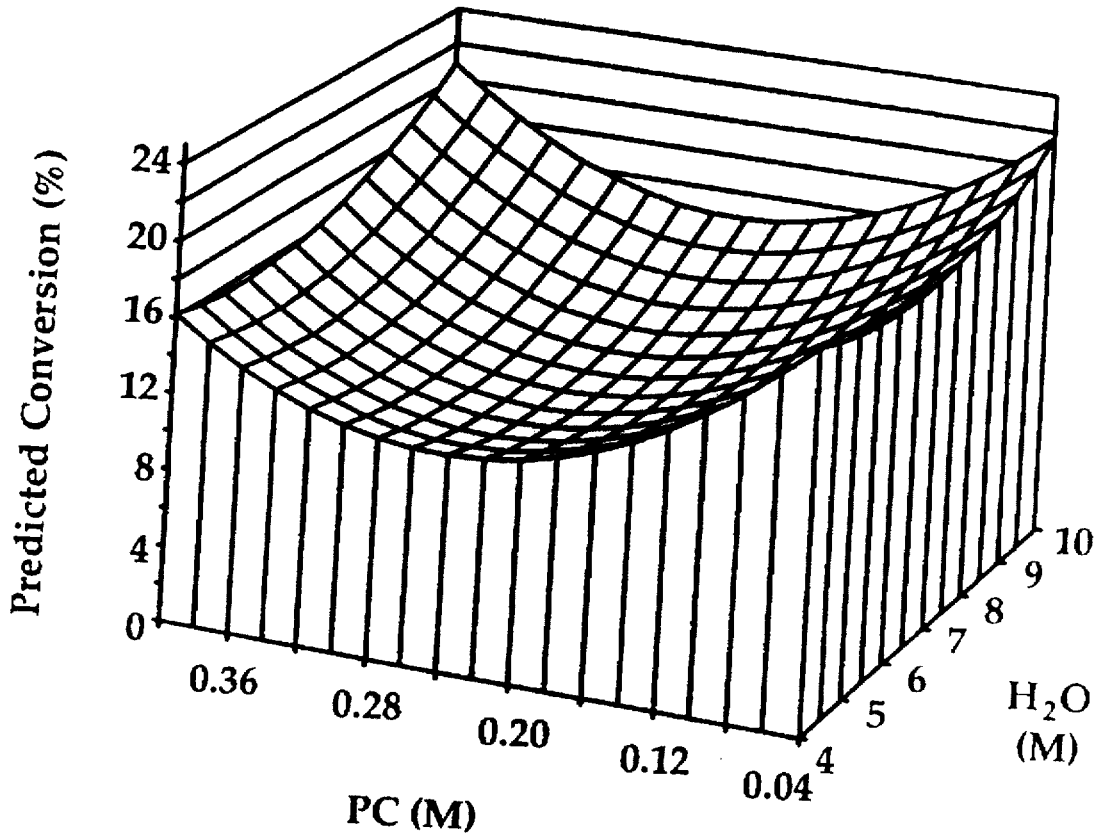

All three enzymes were able to transesterify PC in diesel fuel (FIG. 2). The activity of CE generally rose as the PC concentration increased, and at optimum was roughly twice the optimal activity toward TG (FIGS. 1C, 2C). For IM20 roughly twice as long an incubation was required with PC to obtain extents of transesterification comparable to those seen for TG. Unlike the situation with TG as substrate (FIG. 1B), IM20 did not exhibit a stimulation of activity toward PC at high ethanol concentrations (FIG. 2B). The tolerance of PS-30 to water in the presence of PC was quite notable, with maximum activity occurring throughout the range of concentrations examined (FIGS. 2, E and F), and falling off below and above these values. Optimal water concentrations were five- to ten-fold above those at which IM20 and CE exhibited maximum activity. However, the overall relative activity of PS-30 toward phospholipids was low—with 40- to 50-hour incubations required to achieve degrees of hydrolysis barely half of those achieved in a 6-hour incubation when TG was the substrate (FIGS. 1, E and F).

In the ethanolysis of PC in diesel fuel the enzymes were 10- to 50-fold more tolerant of water than they had been in the ethanolysis of TG. Maximum activities occurred at water concentrations between 1 and 10M (FIG. 2). Furthermore, the amounts of water necessary for maximum activity generally increased as PC concentrations increased (FIG. 2). Similar behavior was observed in earlier studies of the hydrolytic activities of lipases toward TG and PC in organic solvents (Haas et al. 1994. *J. Am. Oil Chem. Soc.* vol. 71, pp. 483–490). In the course of these experiments it was observed that PC increased the solubility of water in organic solvents, probably as a result of the emulsifying activity which arises from the amphiphilic properties of this molecule. Evidently this interaction with PC also modulates the availability of water to the enzymes.

With PC as substrate, both IM20 and CE displayed greatest activity at the lower ethanol concentrations examined, with slight to moderate reductions at higher ethanol concentrations (FIG. 2). The activity of PS-30 was roughly constant across the range of ethanol concentrations examined (FIG. 2). IM20 required longer incubations than CE to achieve significant levels of esterification (48 vs 17 hrs). However, as seen with TG as substrate, this is a relatively small difference compared to that in the activities of these enzymes in aqueous systems (Table 1). IM20 appears to retain its activity better in diesel fuel than do the other enzymes studied here.

Figure 3:
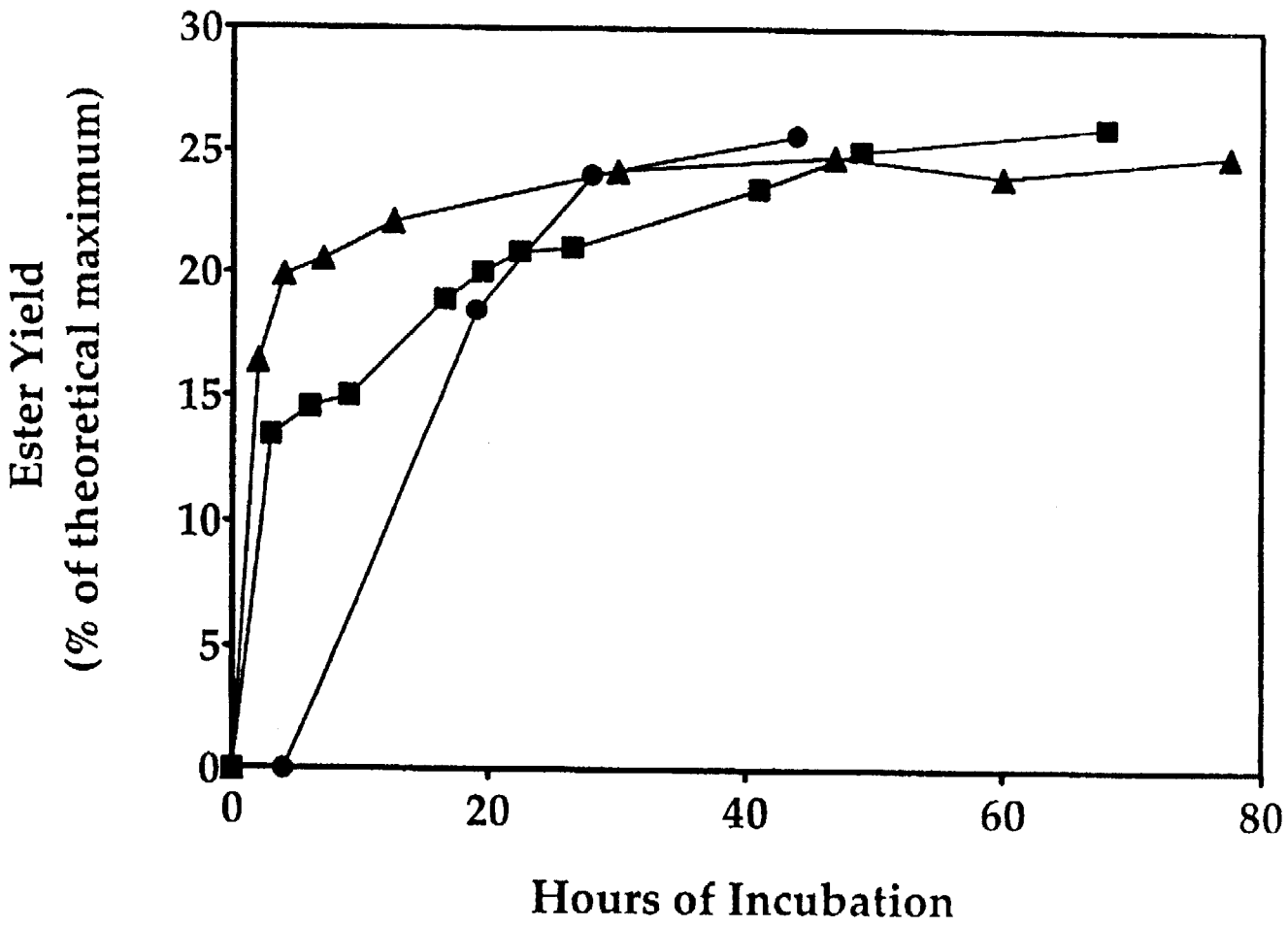
FIG. 3 shows progress curves of the enzymatic ethanolysis of soybean triglycerides (TG) in diesel fuel under reaction conditions predicted by Equation 1 and Table 2 to yield high enzyme activities. (●) Lipozyme™ IM20 (35 mg), TG (0.36M), water (0.060M), ethanol (0.927M); (■) CE lipase (50 mg), TG (0.095M), water (0), ethanol (0.129M); (▲) PS-30 lipase (35 mg), TG (0.29M), water (0.12M), ethanol (0.33M). Data are the averages of duplicate determinations.

To assess the progress of transesterification, time course reactions were conducted under conditions of substrate and water which were predicted by Equation 1 and Table 2 to yield high enzyme activities. The time courses of transesterification of TG are shown in FIG. 3. The levels of activity observed agreed with those predicted by Equation 1 and Table 2. However, complete transesterification of the substrate was not achieved. Despite more than 45 hours of incubation, transesterification stopped at between 20 and 25% of the maximum theoretical value for all three enzymes. PS-30 was the most active of the three enzymes, achieving 20% esterification within the first 4 hours of incubation. However, it exhibited only slight additional activity beyond that time. Qualitatively similar, though quantitatively much lower, activity was shown by the CE lipase. Both PS-30 and CE preparations are reported by the manufacturer to be positionally nonspecific enzymes. Their failure to achieve complete conversion here is at least partly due to the fact that the ethanol concentrations, chosen because they were the ones giving highest enzyme activity, were sufficient to support the ethanolysis of no more than approximately half of the fatty acid content of the substrate. In the case of IM20, although sufficient ethanol was present to support the alcoholysis of more than 85% of the fatty acids present in the TG substrate, only 25% esterification was achieved. *Rhizomucor miehei* lipase, the catalytic component of IM20, is known to hydrolyze only the primary ester positions of glycerides (Huge-Jensen et al. 1987. *Lipids*. vol. 22, pp. 559–565), thus possibly reducing the maximum potential ester yield by this enzyme. In additional experiments, it was determined that further additions of ethanol increased the degrees of TG conversion by PS-30 and CE to 48 and 88%, respectively. This approach, however, did not increase transesterifications by IM20.

Figure 4:
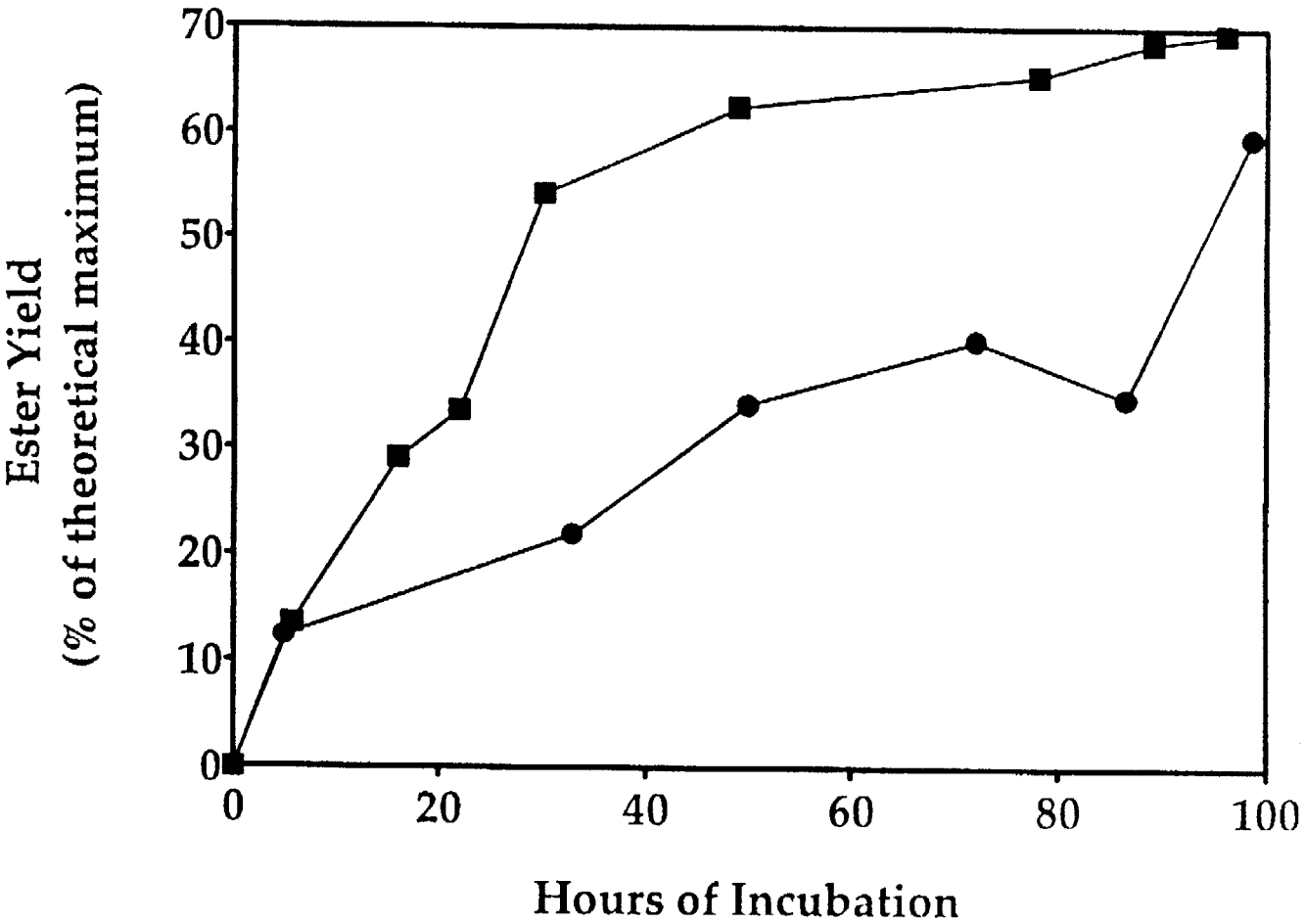
FIG. 4 show progress curves of the enzymatic ethanolysis of soybean phosphatidylcholine (PC) in diesel fuel under conditions predicted by Equation 1 and Table 2 to yield high enzyme activities. (●) Lipozyme™ IM20 (35 mg), PC (0.374M), water (1.85 M), ethanol (0.749M); (■) Lipase CE (50 mg), PC (0.272M), water (3.57M), ethanol (0.311M). Data are the averages of duplicate determinations.

The time courses of PC alcoholysis by IM20 and CE are shown in FIG. 4. (Due to its low activity on PC, a time course was not run for PS-30 lipase.) As with TG esterification, the activities correspond to those predicted by Equation 1 and Table 2. Of the two enzymes, CE was the most active on PC, achieving 50% conversion in 30 hr. This corresponds to alcoholysis of one of the two fatty acids on each PC molecule, and may represent an initial transesterification of the sn-1 position of the substrate. Addition of further aliquots of ethanol did not cause an increase in the transesterification of PC by either enzyme. It is notable that the CE preparation was more active on PC than on TG, achieving greater conversion in a comparable amount of time despite the fact that the initial PC concentration was nearly four-fold greater than that for TG (FIGS. 3 and 4).

The rate of alcoholysis of PC by IM20 was slower than that of CE (FIG. 4), probably due to the fact that the IM20 reaction mixture contained 30% less enzyme (mass basis) and a 38% higher substrate concentration. This suggests that in this reaction system the activity of IM20 is closer to that of CE than was seen when comparing their hydrolytic activities in aqueous reactions (Table 2). Since IM-20 is a sn-1,3-regiospecific enzyme, one would expect a maximum transesterification of 50% of the fatty acid content of PC. The fact that a slightly higher yield than this is achieved (FIG. 4) suggests that there may be a relaxation of specificity under the conditions of these reactions. Alternatively, acyl migration from the sn-2- to the sn-1-position in lysophosphatidylcholine generated by a first transesterification event may allow further enzyme action. Comparison of FIGS. 3 and 4 indicates that on the basis of percent theoretical yield the activity of IM20 toward PC is roughly comparable to that toward TG, but that the enzyme is able to achieve a more complete alcoholysis of the former substrate.

The feasibility of using diesel fuel as a solvent for the enzymatic synthesis of alkyl esters from triglycerides and phospholipids has thus been established, suggesting the application this reaction to the synthesis of biodiesel from low value materials, such as soapstock, which are rich in these lipids and in related compounds and which are refractory to transesterification by conventional technology.

The following examples are intended only to further illustrate the invention and are not intended to limit the scope of the invention as defined by the claims.

EXAMPLES

Example 1

Determination of Lipolytic Activity

A pH-stat method employing a continuous titrating pH meter (Radiometer, Copenhagen, Denmark) was used to determine the lipolytic activity of each lipase in an aqueous reaction system using emulsified soybean oil as the substrate (Haas et al. 1995. *J. Am. Oil Chem. Soc.* vol. 72, pp. 519–525; Haas et al. 1995. *J. Am. Oil Chem. Soc.* In press). Incubations were conducted at 25° C. Enzymes were assayed at pH 8, optimal pH for all.

Example 2

Determination of Ester Synthesis

A Modified Central Composite experimental design (Box et al. 1978. *Statistics for Experimenters.* Wiley, New York, N.Y.) was employed to coordinately study the effects of the concentrations of water, lipid substrate and ethanol on the enzymatic alcoholysis of either TG or PC. For each enzyme, the appropriate concentration ranges of these variables (Table 3) were established by preliminary experiments which identified the portion of variable space beyond which enzymatic activity declined. The upper concentration limit of PC was dictated by the fact that more concentrated solutions were extremely viscous, which restricted proper mixing and prevented accurate sampling. The TG concentration range was chosen to be equimolar to the PC range. The amounts of enzyme employed were chosen to yield between 25 and 40% transesterification of TG within a 6 to 28 hr incubation. Reaction times were: PS-30, 6 hr; CE, 20 hr; IM20, 28 hr. The same amounts of enzyme were used in studies of the esterification of PC, sometimes necessitating longer incubation periods (CE, 17 hr; IM20, 48 hr; PS-30, 49.5 hr) to achieve substantial degrees of conversion.

Alcoholysis reaction mixtures (approximately 5 ml) contained water, ethanol, lipase and either TG or PC in water-saturated diesel fuel. Reactions were made by first dissolving the lipid substrate in diesel fuel, dispensing 5 ml to 20×150 mm screw-cap tubes, and adding desired amounts of water, ethanol and enzyme. Reactions were conducted at 42° C., with orbital shaking at 350 rpm. When time course studies were conducted with TG as the substrate, 50 μl samples were removed from each reaction tube at predetermined incubation times and their ester contents were determined. When PC was the substrate, several identical reactions were incubated, with a whole tube being prepared for analysis at each sampling time. Time course studies were conducted in duplicate for each enzyme-substrate combination. The average variation of the degree of esterification in each reaction tube from the mean for the replicate pairs was 2.5% for the TG substrate and 0.6% for the PC substrate.

Following incubation, the reactions were diluted with hexane, filtered over Millipore Brand Millex FX13 membranes (0.5 μm, Sigma Chemical Co., St. Louis, Mo.) and their ethyl ester contents were determined by high performance liquid chromatography (HPLC) using a Hewlett-Packard (Valley Forge, Pa.) 1050 Chromatography System. Samples containing PC were analyzed with a 3×100 mm Lichrosorb DIOL column (Chrompack Inc., Raritan, N.J.) eluted isocratically with 0.1% isopropanol in hexane at a flow rate of 0.5 ml/min. When TG was the substrate, the determination was conducted using a 3×100 mm Lichrosorb Si 60-5 column eluted with gradients of isopropanol and water in hexane/0.6% glacial acetic acid (Haas et al. 1995. *J. Am. Oil Chem Soc.* vol. 72, pp. 519–525). Analyte peaks, which were baseline resolved under these HPLC conditions, were detected with a mass-based detector (ELSK IIA, Alltech, Deerfield, Ill.) operating at a nitrogen flow rate of 3.5 l/min and a nebulizer temperature of 60° C. to TG and 2.4 l/min, 40° C. for PC. Fatty acid ethyl ester was quantitated by reference to a response curve generated using pure ethyl linoleate. Ester yields (FIGS. 3 and 4) are expressed as percentages of theoretical maximum, calculated on the basis of three available fatty acids in TG and two in PC. Neither hydrolysis of the substrates nor nonenzymatic esterification was observed during these investigations.

L-α-Phosphatidylcholine (PC, >99%, from soybeans) was purchased from Avanti Polar Lipids, Inc. (Alabaster, Al.). The standard, ethyl linoleate, was obtained from Sigma Chemical Co. (St. Louis, Mo.). Food-grade soybean oil, obtained locally, was used directly as a source of soy TG. Enzymes were lyophilized overnight and stored over calcium sulfate at 4° C. prior to use. Ethanol (USP, 200 proof, anhydrous) was produced by the Warner-Graham Co. (Cockeysville, Md.). Hexane and isopropanol (Burdick and Jackson) were purchased from Baxter (Muskegon, Mich.). Grade No. 2 diesel fuel, obtained from local automotive fuel dealers, was saturated with distilled, deionized water by overnight shaking at room temperature (diesel/water, 5/1, v/v) prior to use.

All references cited herein are herein incorporated by reference.

I claim:

1. A method for producing biofuel, said method comprising a) forming a reaction mixture of automotive or related fuel, fatty acid-containing substances, alcohol and lipase, all in amounts effective for a reaction to occur, and water in an amount sufficient to confer enzymatic activity, b) incubating the reaction mixture for a time and at a temperature sufficient for transesterification between the fatty acid-containing substance and the alcohol to occur, c) separating the by-products from the biofuel portion of the mixture.

2. The method of claim 1, wherein said fatty acid-containing substances are triglycerides, phospholipids, fatty acid esters, or esters which are substrates for the lipase.

3. The method of claim 2, wherein said fatty acid-containing substances are triglycerides or phospholipids.

4. The method of claim 1, wherein said alcohol is normal-, iso- or cyclo-series of alkyl alcohol.

5. The method of claim 4, wherein said alcohol is ethanol, propanol, isopropanol, 1-butanol, 2-butanol or isobutanol.

6. The method of claim 1, wherein said lipase is any lipase produced by plants, bacteria, fungi or higher eukaryotes.

7. The method of claim 1, wherein said automotive fuel is diesel fuel or gasoline.

8. The method of claim 1, wherein said incubation temperature is from about room temperature to about 60° C.

* * * * *